United States Patent [19]

Ban et al.

[11] 4,216,682

[45] Aug. 12, 1980

[54] FIBER-REINFORCED LIGHT ALLOY CAST ARTICLE

[75] Inventors: Keisuke Ban, Fujimi; Takeo Arai, Tokyo, both of Japan

[73] Assignee: Honda Giken Kogyo Kabushiki Kaisha, Tokyo, Japan

[21] Appl. No.: 24,436

[22] Filed: Mar. 26, 1979

Related U.S. Application Data

[63] Continuation-in-part of Ser. No. 837,043, Aug. 23, 1977, abandoned.

[51] Int. Cl.[3] ..... B22D 19/02; B32B 7/02; B32B 15/14

[52] U.S. Cl. ..... 74/579 E; 29/156.5 R; 29/156.5 A; 164/91; 164/97; 164/108; 164/113; 164/120; 428/212; 428/218; 428/288

[58] Field of Search ..... 164/91, 97, 108, 113, 164/120; 29/156.5 R, 156.5 A; 74/579 R, 579 E; 428/212, 218, 288

[56] References Cited

U.S. PATENT DOCUMENTS

| | | | |
|---|---|---|---|
| 3,547,180 | 12/1970 | Cochran et al. | 164/97 |
| 3,564,575 | 2/1971 | Catherall | 74/579 R |
| 3,792,726 | 2/1974 | Gakai et al. | 164/120 |
| 3,949,804 | 4/1976 | Kaneko et al. | 164/120 |
| 4,069,576 | 1/1978 | Teysseyre et al. | 164/120 |

*Primary Examiner*—James C. Cannon

*Attorney, Agent, or Firm*—Haseltine, Lake & Waters

[57] ABSTRACT

A fiber-reinforced light alloy cast article for use in various mechanical parts such as, for example, a connecting rod, a rocker arm, and so forth in an internal combustion engine. The composite light alloy cast article includes therein a portion filled with a shaped body made of an inorganic fiber material of high elasticity and high mechanical strength, and another portion filled with a shaped body of inorganic fibers having low elasticity and high hardness and having an appropriate bulk density suited for required purposes, the fiber-shaped bodies being filled in the required portions of the composite light alloy cast article by high pressure solidification casting.

3 Claims, 8 Drawing Figures

(A)

(B)

(A)

(B)

(A)

(B)

(A)

(B)

FIBER-REINFORCED LIGHT ALLOY CAST ARTICLE

CROSS-RELATED APPLICATION

This application is a continuation-in-part of copending application Ser. No. 837,043 filed Sept. 23, 1977, and now abandoned.

BACKGROUND OF THE INVENTION

1. Field of the Invention

The present invention relates to a fiber-reinforced light alloy cast article.

2. Description of the Prior Art

In U.S. patent application Ser. No. 914,297 filed June 9, 1978 by the present inventors, which is a continuation of U.S. patent application Ser. No. 725,990 filed Sept. 23, 1976 and now abandoned, there was proposed a composite cast article which was produced by filling a shaped article of fiber in one or entire portion of a light alloy cast article by the high pressure solidification casting method.

The fiber-reinforced light alloy article of this sort possesses a mechanical characteristic which is comparable with iron and steel material, when it is used in the component parts for an internal combustion engine. In addition, the composite cast article, being light in its weight, reduces energy of motion to improve the mechanical efficiency of the component parts, hence it contributes to improvement in the fuel consumption as well as to effective saving of the limited natural resources.

SUMMARY OF THE INVENTION

It is therefore a primary object of the present invention to provide a fiber-reinforced light alloy cast article which has been further developed from the above-mentioned composite cast article, and in which two different kinds of fiber-shaped bodies, each having different physical properties, are used to properly reinforce the light alloy cast article.

According to the present invention, there is provided a fiber-reinforced light alloy cast article having therein a portion filled with a fiber shaped body made of a mechanically strong inorganic fiber material of high elasticity having a bulk density range of from 0.10 g/cc to 0.80 g/cc, and another portion filled with a shaped body of a hard inorganic fiber having low elasticity having a bulk density range of from 0.30 g/cc to 1.0 g/cc, filling of the fiber shaped bodies in the required portions of the light alloy cast article being carried out by high pressure solidification casting.

There has thus been outlined rather broadly the more important features of the invention in order that the ensuing detailed description thereof may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based, may be readily utilized as a basis for the designing of other structures for carrying out the several purposes of the invention. It is important, therefore, that the claims be regarded as including such equivalent constructions so far as it does not depart from the spirit and scope of the present invention.

BRIEF DESCRIPTION OF THE ACCOMPANYING DRAWINGS

Specific embodiments of the invention have been chosen for the purposes of illustration and description, and are shown in the accompanying drawings, forming a part of the specification, in which.

DETAILED DESCRIPTION OF PREFERRED EMBODIMENTS

For the afore-mentioned inorganic fiber material having high elasticity and high mechanical strength, there may be used stainless steel fiber (young's modulus of about 19,000 kg/mm$^2$), silicon carbide fiber (young's modulus of 15,000~35,000 kg/mm$^2$), high elasticity carbon fiber of high mechanical strength (young's modulus of 25,000~35,000 kg/mm$^2$), and so forth. Thus, inorganic fibers of high elasticity as referred to in the specification and claims are generally defined to mean those having young's modulus of more than 15,000 kg/mm$^2$. These fiber materials are used mainly for reinforcing the mechanical strength of the cast article.

For the inorganic fiber having low elasticity and high hardness, there may be used low elasticity carbon fiber (young's modulus of about 4,500 kg/mm$^2$), crystallized glass fiber (young's modulus of about 8,500 kg/mm$^2$), and ceramic fibers (young's modulus of about 7,000 kg/mm$^2$). Thus, inorganic fibers of low elasticity as referred to in the specification and claims are generally defined to mean those having young's modulus of less than 10,000 kg/mm$^2$.

These inorganic fibers are mainly used for improving the friction-resistant property, the impact-resistant property, and the creep-resistant property of the cast article to be obtained.

In order to enable skilled artisans in this field of art to reduce the present invention into practice, the following preferred examples are presented. It should be noted here that these examples are merely illustrative, and are not intended to limit the scope of the present invention.

EXAMPLE 1

Casting of Connecting Rod of Aluminum Alloy for Internal Combustion Engine

Figure 1:
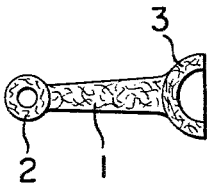
FIG. 1(A) is a plan view of a fiber shaped body for a connecting rod.
FIG. 1(B) is a side elevational view of the fiber shaped body for the connecting rod shown in FIG. 1(A)
Figure 1:
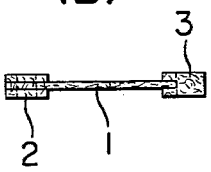
Figure 2:
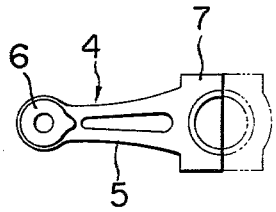
FIG. 2(A) is a plan view of a connecting rod.
FIG. 2(B) is a side elevational view of the connecting fod shown in FIG. 2(A)
Figure 2:
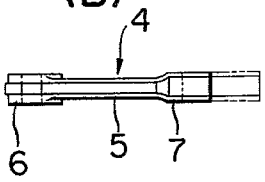

A fiber body in the form of felt having a bulk density of 0.20 g/cc which is manufactured by the use of stainless steel fiber having a diameter of 8 microns was punched into a shaped fiber body 1 in the form of a rod, as shown in FIG. 1(A). On the other hand, an annular shaped fiber body 2 of a small diameter and a semi-annular fiber shaped body 3 having a large diameter, both having a bulk density of 0.6 g/cc, were manufactured by the use of crystallized glass fiber having a diameter of 2 microns. Subsequently, these annular and semi-annular shaped fiber bodies 2 and 3 are securely fixed on both end parts of the rod-shaped fiber body 1, one end of which is for the annular shaped body of a small-diameter, and the other end of which is for the semi-annular shaped body of a large-diameter, as shown in FIGS. 1(A) and 1(B). After this process, the entire shaped fiber body in the form of the connecting rod is placed within a cavity of a casting mold for the connecting rod, and then melt of an aluminum alloy ("AC8B material" in accordance with the Japanese Industrial Standard (JIS)) as the matrix was poured in onto the shaped fiber body in the mold cavity, followed by casting of the connecting rod by the high pressure solidification casting method with simultaneous filling and impregnation of the melt into the above-mentioned fiber shaped bodies 1, 2, and 3, thereby producing the connecting rod of the fiber-reinforced light alloy by casting, as shown in FIGS. 2(A) and 2(B).

In the same manner, a rod cap was cast by the use of a semi-annular shaped body made of glass fiber.

On testing, it was found that the above-described connecting rod was sufficiently reinforced to a required mechanical strength at its rod section, and the wear-resistant property and the creep-resistant property at both small-diameter portion 6 and larger-diameter portion 7 were excellent.

When this connecting rod was subjected to a single body test and a bench durability test, it was revealed that the rod was lighter in weight than a forged article of conventional carbon steel (S48C material in accordance with Japanese Industrial Standard (JIS)) by about 250 g (per piece), so that the inertial weight of the intarnal combustion engine was remarkably reduced, and that such light weight effectively contributes to reduction in the overall weight of the engine. At the same time, the thus obtained connecting rod was found to be excellent in its buckling strength, bending strength, and high temperature strength characteristics. In this consequence, it was discovered that the connecting rod of this invention could have substantially the same cross-sectionalshape as that produced from iron and steel materials. This fact constitutes a remarkable contrast to a case, in which, when a conventional aluminum alloy was used, considerable reinforcement was required to rigidly maintain its configuration.

EXAMPLE 2

Manufacture of Rocker Arm for Internal Combustion Engine

Figure 3:
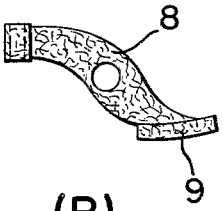
FIG. 3(A) is a plan view of a fiber shaped body for a rocker arm.
FIG. 3(B) is a side elevational view for the rocker arm shown in FIG. 3(A)
Figure 3:
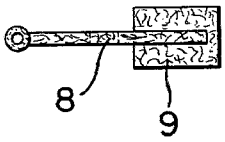
Figure 4:
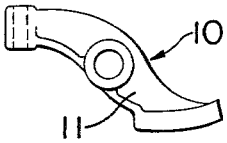
FIG. 4(A) is a plan view of a rocker arm.
FIG. 4(B) is a side elevational view of the rocker arm shown in FIG. 4(A).
Figure 4:
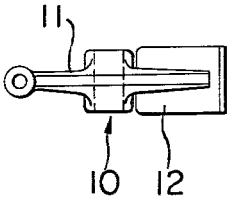

As shown in FIGS. 3(A) and 3(B), a shaped fiber body 8 for the arm portion of the rocker arm having a bulk density of 0.3 g/cc was produced by the use of stainless steel fiber of 8 microns in diameter, while another shaped fiber body 9 for the slipper surface having a bulk density of 0.7 g/cc was produced by the use of crystallized glass fiber of 2 microns in diameter. These shaped fiber bodies 8 and 9 were assembled and placed in a mold cavity for casting the rocker arm, after which melt of an aluminum alloy ("AC8B material" in accordance with the Japanese Industrial Standard (JIS)) as a matrix was poured into the mold cavity so as to impregnate the melt into the above-mentioned shaped fiber bodies 8 and 9 simultaneously with the casting under the high pressure solidification method, thereby obtaining the rocker arm 10 made of the fiber-reinforced light alloy, as shown in FIGS. 4(A) and 4(B).

The rocker arm thus obtained was found to have been sufficiently reinforced in its strength at the arm portion thereof, and the slipper surface 12 thereof was also excellent in its wear-resistant property.

When this rocker arm was subjected to the engine test and durability test by the use of a cam shaft made of cast-iron which was subjected to nitrogenation-treatment, it was found that no functional deficiency existed in the arm portion, and the sliding condition of the slipper surfaces was also satisfactory.

The above-described shaped body of the metal fiber exhibits its effect with the bulk density of the shaped body of from 0.1 g/cc or so. With the bulk density of 0.8 g/cc and above, the specific gravity of the resultant composite body becomes large, as the result of which the weight reducing effect in the shaped body will be small. Ideally, the bulk density range of from 0.20 g/cc to 0.50 g/cc is preferable from the standpoint of the mechanical strength and the weight in the resulting composite body. Also, the shaped body of ceramic fiber exhibits satisfactory hardness and creep-resistance with its bulk density of from 0.30 g/cc, although a value of 0.5 g/cc and above is preferable from the aspect of its increased wear-resistant effect. Beyond the bulk density of 1.0 g/cc, the shaped article will become liable to cause scratches and scars on a counterpart object, with which it may come into contact, or to reduce its impact-resistant property to a considerable degree, hence such large bulk density is not desirable from the point of practical use of the composite body.

As has so far been stated in detail in the foregoing, the fiber-reinforced light alloy cast article according to the present invention is so produced that shaped fiber bodies having mutually different physical properties are placed at their designated portion in a cast article in accordance with the function they are to perform, and then combined with metal alloy at the time of its casting, where each shaped fiber body is impregnated with the cast metal by the aid of the high pressure solidification casting method. Consequently, the present invention is capable of carrying out more effectively the fiber reinforcement than in the case where a shaped fiber body of a single physical property is utilized, so that the resultant fiber-reinforced light alloy cast article of the present invention has wide practical applications.

What is claimed is:

1. A fiber-reinforced light alloy cast article having a light alloy matrix, including a portion filled with a shaped body of a mechanically strong inorganic fiber material of high elasticity having young's modulus of more than 15,000 kg/mm$^2$ and a bulk density ranging from 0.10 g/cc to 0.80 g/cc, and a sliding contact portion filled with a shaped body of a hard inorganic fiber material of low elasticity having young's modulus of less than 10,000 kg/mm$^2$ and a bulk density ranging from 0.30 g/cc to 1.0 g/cc, both of said shaped fiber bodies being filled into the light alloy matrix by means of high pressure solidification casting.

2. The cast article of claim 1 in the form of a connecting rod for an internal combustion engine having a rod section, a big end and a small end, wherein the rod section is reinforced with a metal fiber of high elasticity having young's modulus of more than 15,000 kg/mm$^2$ and a bulk density ranging from 0.10 g/cc to 0.80 g/cc, and the ends of said rod are reinforced with a hard inorganic fiber of low elasticity having young's modulus of less than 10,000 kg/mm$^2$ and a bulk density ranging from 0.30 g/cc to 1.0 g/cc.

3. The cast article of claim 1 in the form of a rocker arm for an internal combustion engine having an arm portion and a slipper surface, wherein the arm portion is reinforced with a metal fiber of high elasticity having young's modulus of more than 15,000 kg/mm$^2$ and a bulk density ranging from 0.10 g/cc to 0.80 g/cc, and the slipper surface is reinforced with a hard inorganic fiber of low elasticity having young's modulus of less than 10,000 kg/mm$^2$ and a bulk density ranging from 0.30 g/cc to 1.0 g/cc.

* * * * *